US007386940B2

(12) United States Patent
Yeh

(10) Patent No.: US 7,386,940 B2
(45) Date of Patent: Jun. 17, 2008

(54) HAIRDRESSING SCISSORS AND POSITIONING DEVICE THEREOF

(75) Inventor: Wen-Ya Yeh, Taiann (TW)

(73) Assignee: Yanni Co., Ltd., Tainan (TW)

( * ) Notice: Subject to any disclaimer, the term of this patent is extended or adjusted under 35 U.S.C. 154(b) by 187 days.

(21) Appl. No.: 11/328,854

(22) Filed: Jan. 9, 2006

(65) Prior Publication Data

US 2007/0157474 A1 Jul. 12, 2007

(51) Int. Cl.
*B26B 13/00* (2006.01)

(52) U.S. Cl. ..... 30/226; 30/227; 30/254

(58) Field of Classification Search ..... 30/145–147, 30/194–197, 226, 227, 229, 254, 260, 123, 30/148, 149, 150; 132/213; D8/5, 57; 403/322.2
See application file for complete search history.

(56) References Cited

U.S. PATENT DOCUMENTS 596,213 A * 12/1897 Loewenthal ..... 30/226
1,288,617 A * 12/1918 Kupiszewski ..... 30/324
5,875,553 A * 3/1999 Geib et al. ..... 30/226
5,996,592 A * 12/1999 Choy ..... 132/200
6,557,263 B1 * 5/2003 Yeh ..... 30/226
6,601,304 B2 * 8/2003 Yeh ..... 30/226
6,634,106 B2 * 10/2003 Yeh ..... 30/226
6,748,662 B2 * 6/2004 Yeh ..... 30/226
7,207,112 B2 * 4/2007 Yeh ..... 30/226
7,269,903 B2 * 9/2007 Yeh ..... 30/226
2006/0150425 A1 * 7/2006 Yeh ..... 30/226
2006/0272160 A1 * 12/2006 Yeh ..... 30/226
2007/0044319 A1 * 3/2007 Yeh ..... 30/194

* cited by examiner

*Primary Examiner*—Stephen Choi
(74) *Attorney, Agent, or Firm*—Pro-Techtor Int'l Services

(57) ABSTRACT

A pair of hairdressing scissors and a positioning device thereof, the pair of hairdressing scissors having a connecting structure formed with a recess, a protrusion and a through hole. A positioning device is disposed in the through hole and includes a retaining member, an elastic member and a fixing member. When coupling a plurality of pairs of hairdressing scissors together, the protrusion of a pair of hairdressing scissors is engaged in the recess of another pair of hairdressing scissors. The protrusion moves toward and presses the retaining member, so that the retaining member will overcome the elastic force of the elastic member and retract into the through hole.

8 Claims, 6 Drawing Sheets

HAIRDRESSING SCISSORS AND POSITIONING DEVICE THEREOF

BACKGROUND OF THE INVENTION

1. Field of the Invention

The present invention relates to a pair of hairdressing scissors and the positioning device thereof, and more particularly to a technique with which plural pairs of such hairdressing scissors can be positioned well after being detachably secured to one another.

2. Description of the Prior Art

The present invention relates to an improvement to the patents for the technique of connecting hairdressing scissors, that were previously obtained by the applicant, such as U.S. Pat. Nos. 6,192,590 B1 and 6,634,106 B2. These patents allow a plurality of pairs of hairdressing scissors to be connected one another either in a parallel fashion or in a cascade fashion, so that the hairstylist can hold the plural pairs of hairdressing scissors in the same hand easily for proceeding with trimming, thinning or layering of the hair to obtain the desired special hairstyle. However, as shown in FIG. 1, each of the first blade 10 and the second blade 20 of the two pairs of hairdressing scissors 1 is provided a connecting structure 80, in the front surface and on the rear surface of the connecting structure 80 are formed a recess 81 and a protrusion 82, so that a plurality of pairs of hairdressing scissors can be secured to one another in such a manner that the protrusion 82 of a pair of hairdressing scissors is engaged in the recess 81 of another pair of hairdressing scissors. Due to the protrusion 82 is engaged in the recess 81 in a sliding manner, the protrusion 82 is very likely to slide or move relative to the recess 81, and the plural pairs of hairdressing scissors 1 cannot be positioned firmly relative to one another. Therefore, when the hairstylist holds the plural pairs of hairdressing scissors in the same hand to do hair cutting, the plural pairs of hairdressing scissors 1 will slide relative to each other, and this will make it inconvenient for the hairstylist to hold the plural pairs of scissors firmly with one hand.

The present invention has arisen to mitigate and/or obviate the afore-described disadvantages.

SUMMARY OF THE INVENTION

The primary objective of the present invention is to provide a pair of hairdressing scissors and a positioning device thereof, the first blade and/or the second blade of the pair of hairdressing scissors installs at least a connecting structure, a front surface and a rear surface of the connecting structure being formed a recess and a protrusion, respectively. The connecting structure is defined a through hole and a stop portion formed at a front end of the through hole, the front end of the through hole connected to the recess. At least a positioning device is disposed in the through hole and includes a retaining member, an elastic member and a fixing member, the retaining member and the elastic member are sequentially placed in the through hole, and then the fixing member is inserted in the through hole, the elastic member is biased between the fixing member and the retaining member in such a manner that the retaining member partially protrudes out of the front end of the through hole and is pressed against the stop portion. When coupling a plurality of pairs of hairdressing scissors together, the protrusion of a pair of hairdressing scissors is engaged in the recess of another pair of hairdressing scissors. The protrusion moves toward and presses the retaining member, so that the retaining member will overcome the elastic force of the elastic member and retract into the through hole. When the protrusion traverses the retaining member completely, the retaining member, under the effect of the restoring force of the elastic member, will partially move out of the front end of the through hole and stop against the lower end of the protrusion. In this way, the plural pairs of hairdressing scissors can be coupled and positioned relative to one another firmly, thus enabling the hairstylist to hold the plural pairs of hairdressing scissors with one hand more easily and stably.

The secondary objective of the present invention is to provide a pair of hairdressing scissors and a positioning device thereof, the first blade and/or the second blade of the pair of hairdressing scissors installs at least a connecting structure, a front surface and a rear surface of the connecting structure being formed a recess and a protrusion, respectively. The connecting structure is defined a through hole, the front end of the through hole connected to the recess. A positioning device is disposed in the through hole and includes a retaining member with a supporting rod, a positioning piece, a stop piece, an elastic member and a fixing member. The retaining member and the elastic member are sequentially placed in the through hole, and then the fixing member is inserted in the through hole. The positioning piece and the stop piece are mounted on the supporting rod, the positioning piece is fixed in the through hole. The elastic member is biased between the stop piece and the fixing member, and then the stop piece abuts against the positioning piece, so that the retaining member will partially protrude out of the front end of the through hole under the effect of the elastic member. When coupling a plurality of pairs of hairdressing scissors together, the protrusion of a pair of hairdressing scissors is engaged in the recess of another pair of hairdressing scissors. The protrusion moves toward and presses the retaining member, so that the retaining member will overcome the elastic force of the elastic member and retract into the through hole. When the protrusion traverses the retaining member completely, the retaining member, under the effect of the restoring force of the elastic member, will partially move out of the front end of the through hole and stop against the lower end of the protrusion. In this way, the plural pairs of hairdressing scissors can be coupled and positioned relative to one another firmly.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
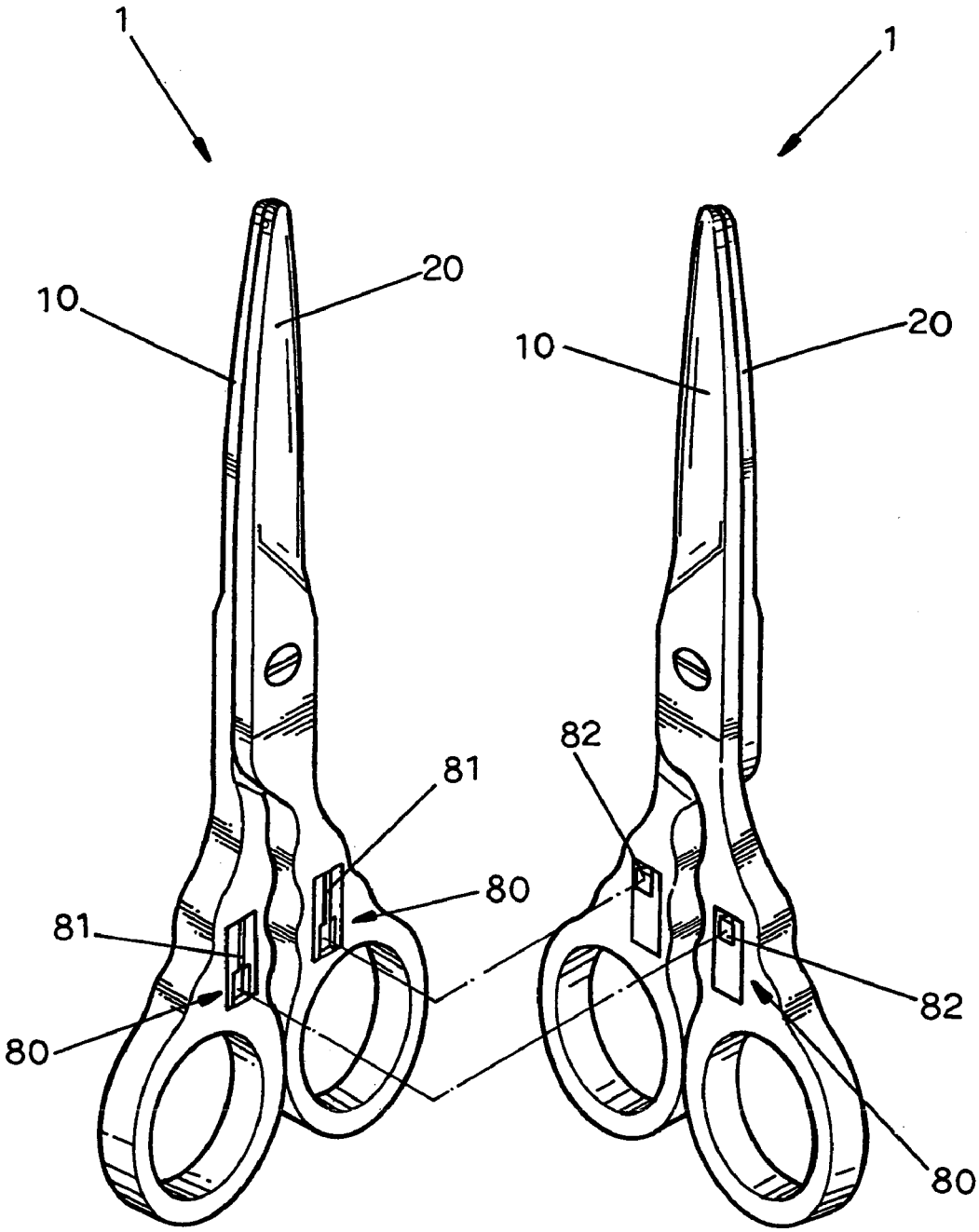
FIG. 1(Prior Art)
FIG. 1 is an exploded view of two pairs of conventional hairdressing scissors that each has a connecting structure.
Figure 2:
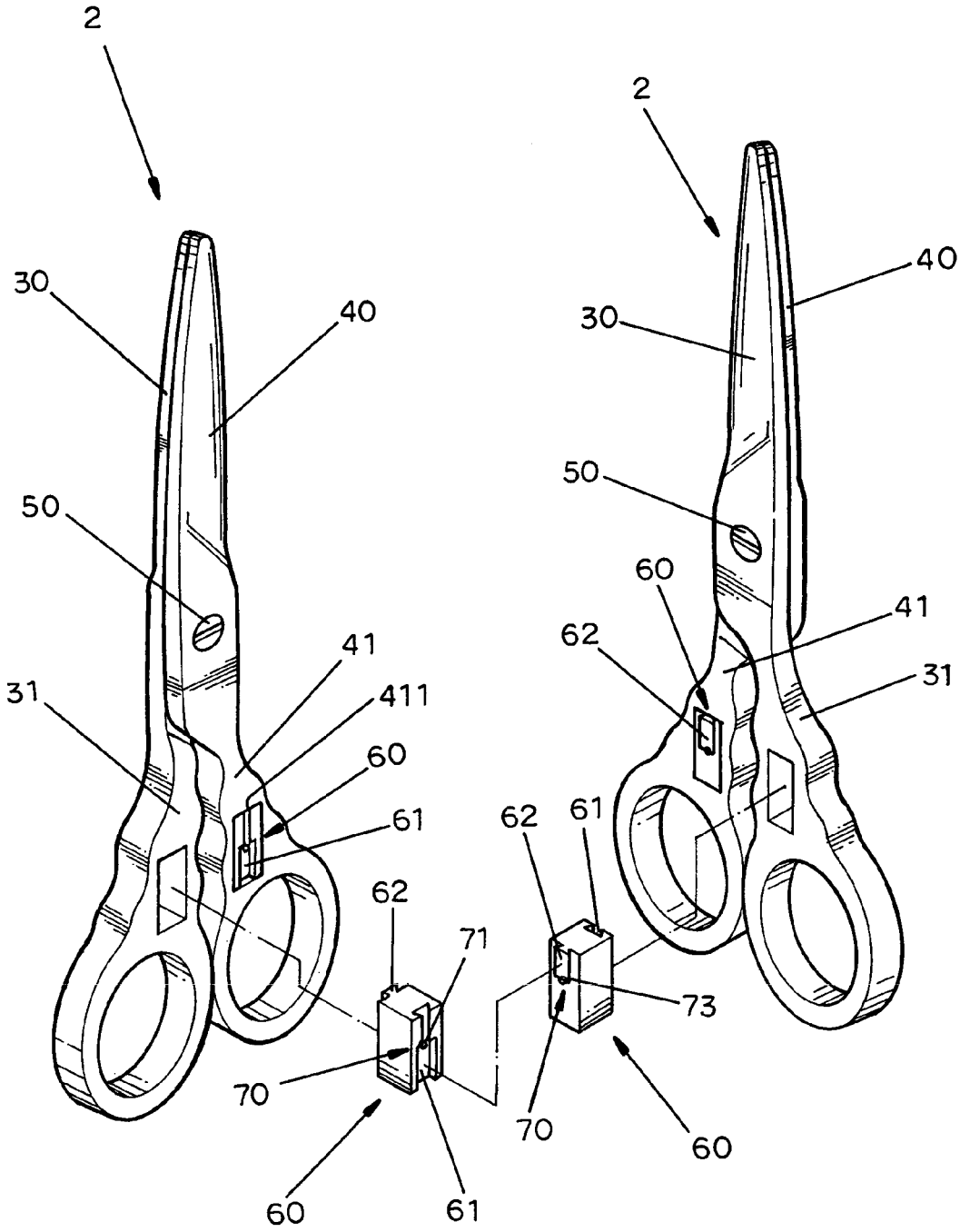
FIG. 2 is an exploded view of showing a first embodiment of the present invention.
Figure 3:
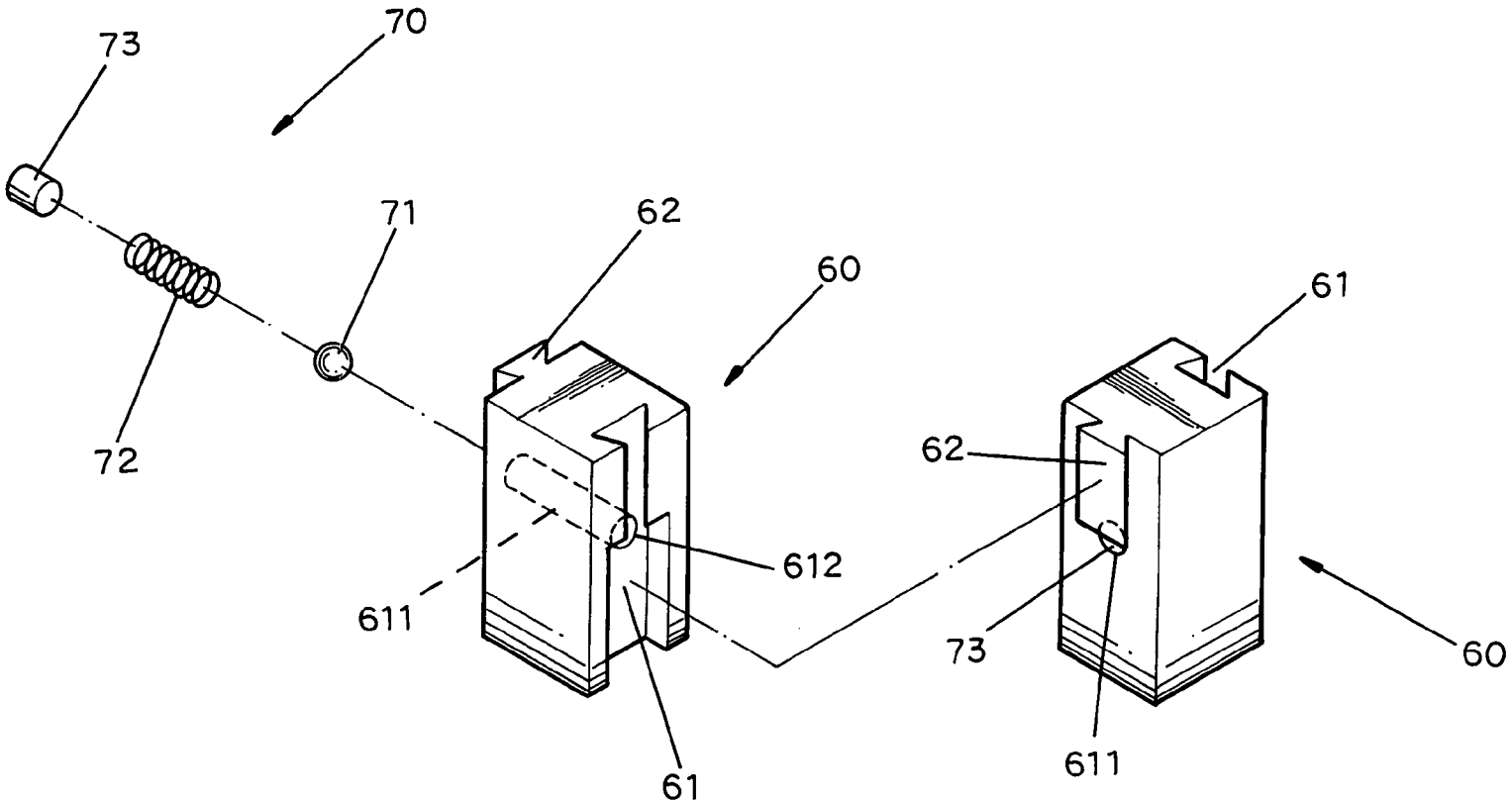
FIG. 3 is an exploded view of showing a connecting structure and a positioning device in accordance with the first embodiment of the present invention.
Figure 4:
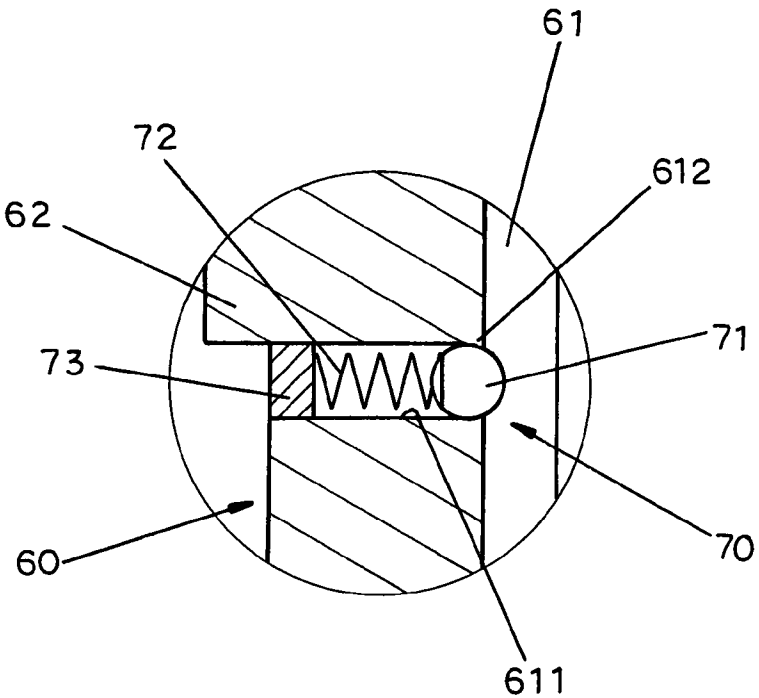
FIG. 4 is an enlarged cross sectional view of showing the positioning device in accordance with the first embodiment of the present invention.

Referring to FIGS. 2 and 3, wherein a first blade 30 and a second blade 40 of a pair of hairdressing scissor 2 in accordance with a first embodiment of the present invention are pivotally connected to each other by a pivot 50. Each of the handle portions 31 and 41 of the first blade 30 and/or the second blade 40 installs at least a connecting structure 60, the front and rear surfaces of the connecting structure 60 are formed a recess 61 and a protrusion 62, respectively. The protrusion 62 and the recess 61 are interlocked each other in a dovetail or other arrangements, and the connecting structure 60 also can take other forms. The connecting structure 60 is defined a through hole 611 and a stop portion 612 formed at the front end of the through hole 611. As shown in FIG. 4, in the through hole 611 are arranged a positioning device 70 that includes a retaining member 71, an elastic member 72 and a fixing member 73. The retaining member 71 and the elastic member 72 are sequentially placed in the through hole 611, and then the fixing member 73 is inserted in the rear end of the through hole 611, so that the elastic member 72 is biased between the fixing member 73 and the retaining member 71. The retaining member 71 partially protrudes out of the front end of the through hole 611 and is confined within the recess 61 by the stop portion 612.

Figure 5:
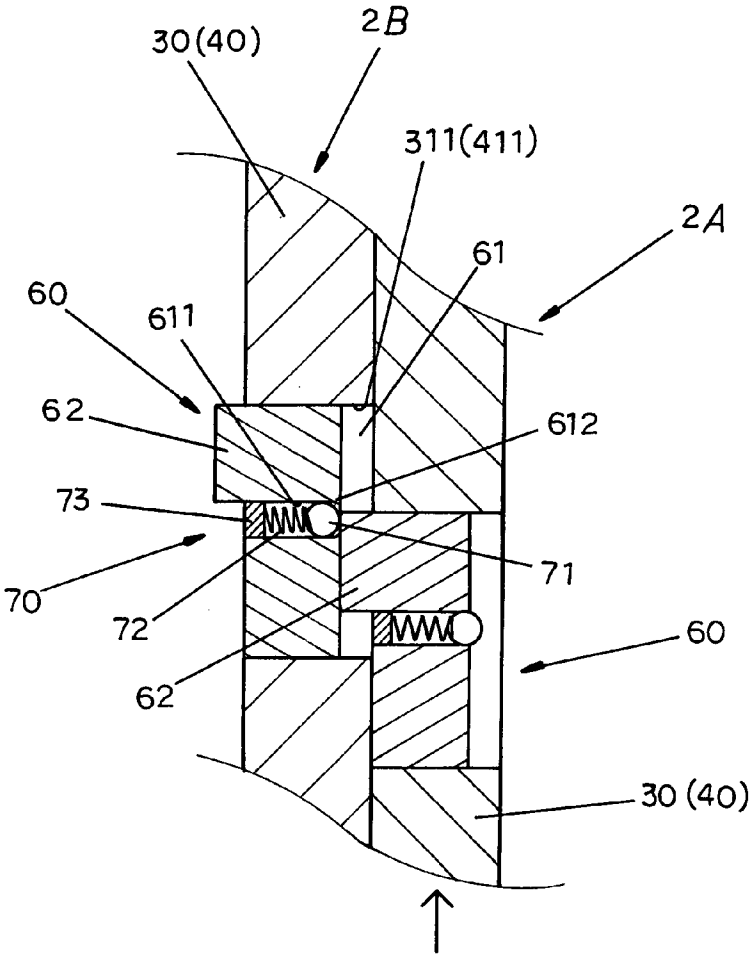
FIG. 5 is an operational view in accordance with the first embodiment of the present invention, of showing that two pairs of hairdressing scissors are being coupled each other.
Figure 6:
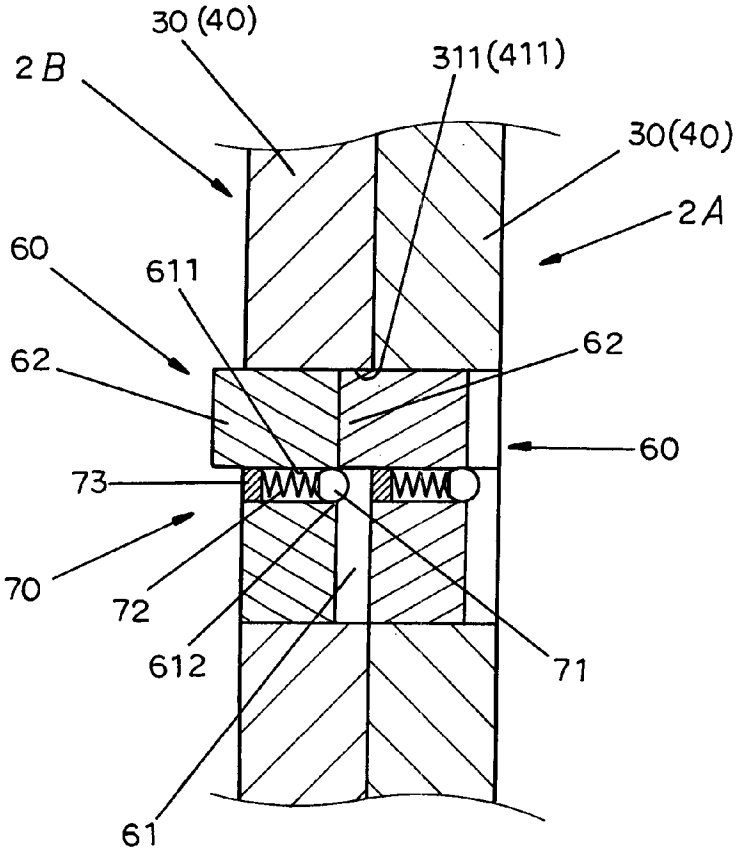
FIG. 6 is a cross sectional view in accordance with the first embodiment of the present invention, of showing that two pairs of hairdressing scissors that have been coupled each other.

A plurality of pairs of hairdressing scissors 2 are connected together in such way that the protrusion 62 of a pair of hairdressing scissors 2A is engaged in the recess 61 of another pair of hairdressing scissors 2B. The protrusion 62 moves toward and presses the retaining member 71, so that the retaining member 71 will overcome the elastic force of the elastic member 72 and retract into the through hole 611. At this moment, the elastic member 72 is in a compressed state, as shown in FIG. 5. When the protrusion 62 traverses the retaining member 71 completely, and the top end of the protrusion 62 stops against the retaining walls 311 and 411 defined between the handle portions 31 and 41 and the recess 61, the retaining member 71, under the effect of the restoring force of the elastic member 72, will partially move out of the front end of the through hole 611 and stop against the lower end of the protrusion 62, as shown in FIG. 6. In this way, the two pairs of hairdressing scissors 2A and 2B are coupled and positioned relative to each other, and the plural pairs of hairdressing scissors can be positioned relative to each other in the same way.

Figure 7:
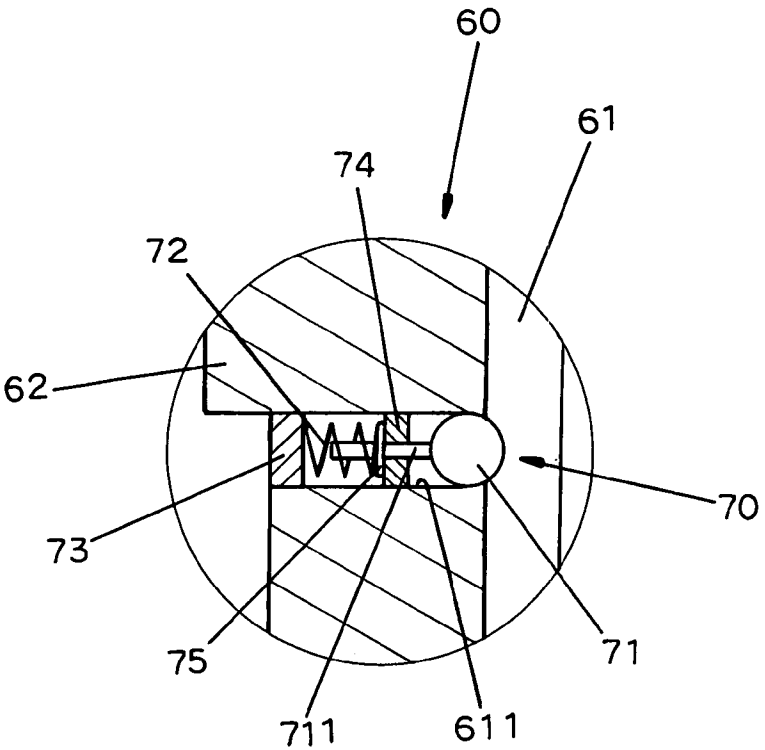
FIG. 7 is an enlarged cross sectional view of showing the positioning device in accordance with a second embodiment of the present invention.

Referring to FIG. 7, a positioning device 70 in accordance with a second embodiment of the present invention is shown and includes a retaining member 71 having a supporting rod 711, an elastic member 72 and a fixing member 73. On the supporting rod 711 are mounted a positioning piece 74 and a stop piece 75. The retaining member 71 and the elastic member 72 are sequentially received in the through hole 611, so as to fix the positioning piece 74 into the through hole 611. Then the fixing member 73 is fixed in the rear end of the through hole 611, the elastic member 72 is biased between the stop piece 75 and the fixing member 73, and then the stop piece 75 abuts against the positioning piece 74, so that the retaining member 71 partially protrudes out of the front end of the through hole 611 and is confined within the recess 61.

Figure 8:
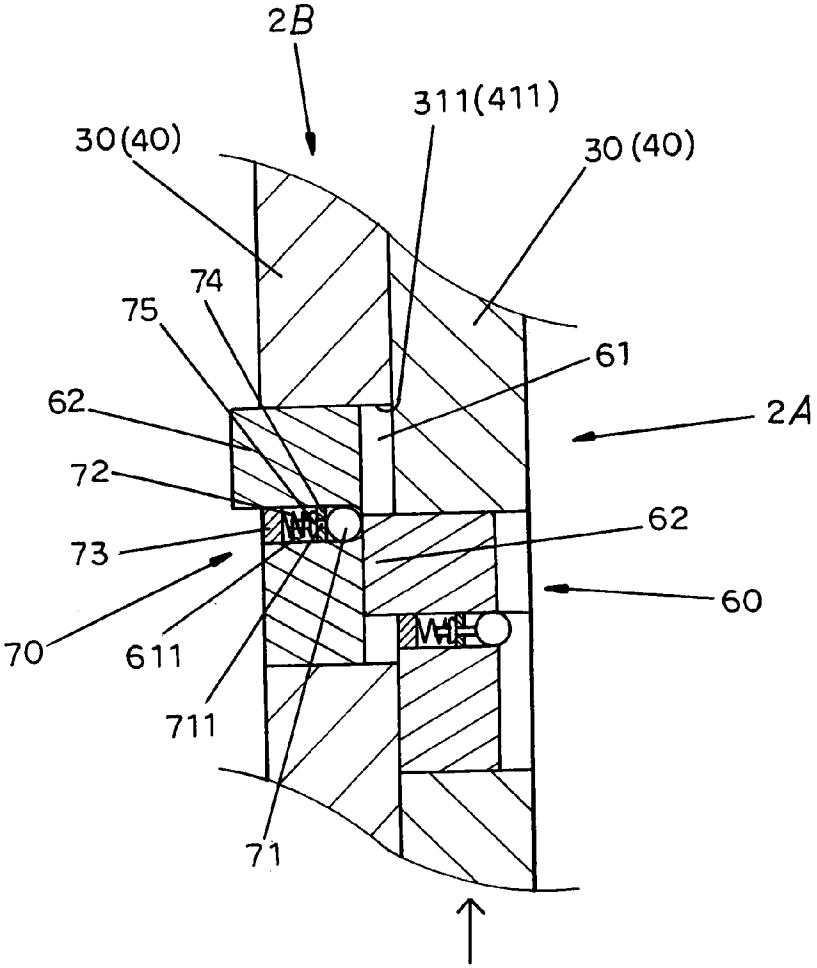
FIG. 8 is an operational view in accordance with the second embodiment of the present invention, of showing that two pairs of hairdressing scissors are being coupled each other.
Figure 9:
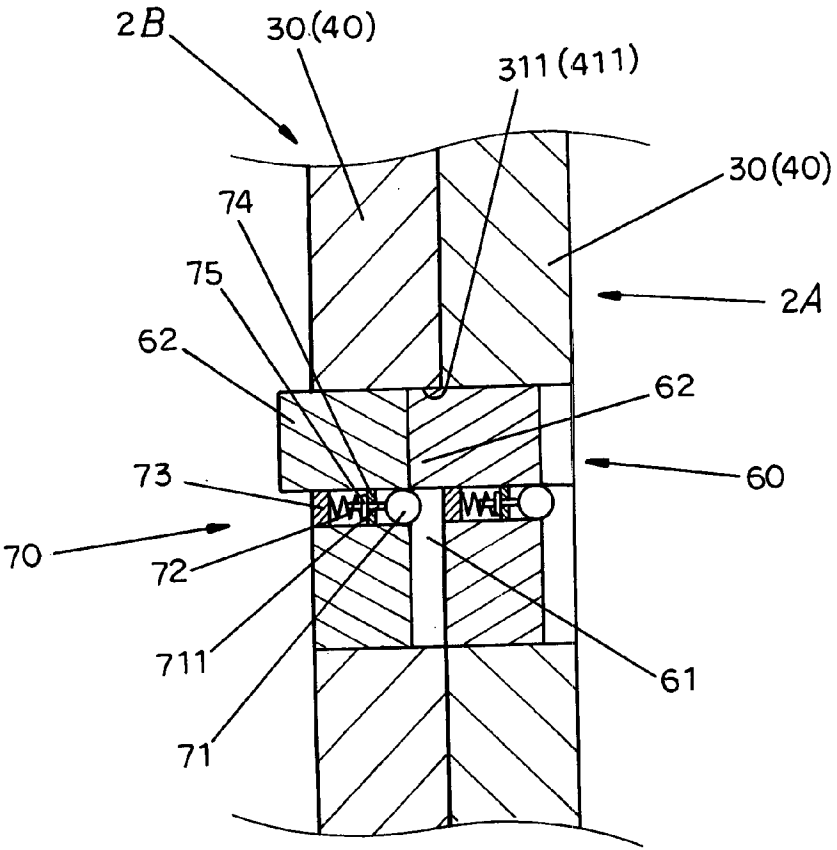
FIG. 9 is a cross sectional view in accordance with the second embodiment of the present invention, of showing that two pairs of hairdressing scissors that have been coupled each other.

In the same way, the plural pairs of hairdressing scissors 2 are connected together in such way that the protrusion 62 of a pair of hairdressing scissors 2A is engaged in the recess 61 of another pair of hairdressing scissors 2B. The protrusion 62 moves toward and presses the retaining member 71, so that the retaining member 71 will overcome the elastic force of the elastic member 72 and retract into the through hole 611. At this moment, the elastic member 72 is in a compressed state, as shown in FIG. 8. When the protrusion 62 traverses the retaining member 71 completely, and the top end of the protrusion 62 stops against the retaining walls 311 and 411 defined between the handle portions 31 and 41 and the recess 61, the retaining member 71, under the effect of the restoring force of the elastic member 72, will partially move out of the front end of the through hole 611 and stop against the lower end of the protrusion 62, as shown in FIG. 9. In this way, the two pairs of hairdressing scissors 2A and 2B are coupled and positioned relative to each other, and the plural pairs of hairdressing scissors can be positioned relative to each other in the same way.

The retaining member 71 in the first and second embodiments is preferably a ball, but it also can be in other forms. The elastic member 72 in the first and second embodiments can be spring, reed or other elastic materials.

Furthermore, the fixing member 73 is fixed in the through hole 611 by screwing, bell and spigot joint, gluing, soldering or any other methods. In this present invention, the fixing member 73 and the through hole 611 are connected by bell and spigot joint.

The operation of coupling and positioning the two pairs of hairdressing scissors 2A and 2B is as described in the first and second embodiment, and the two pairs of hairdressing scissors 2A and 2B also can be separated from each other by a reverse operation to the coupling operation.

Therefore, the present invention is made up of the above-mentioned structures, and it truly has the following advantages as compared with the prior art:

When assembling the plural pairs of hairdressing scissors 2 together, the protrusion 62 of a pair of hairdressing scissors 2A is engaged in the recess 61 of another pair of hairdressing scissors 2B. The protrusion 62 moves toward and presses the retaining member 71, so that the retaining member 71 will overcome the elastic force of the elastic member 72 and retract into the through hole 611. When the protrusion 62 traverses the retaining member 71 completely, and the top end of the protrusion 62 stops against the retaining walls 311 and 411 defined between the handle portions 31 and 41 and the recess 61. The elastic member 72 will be decompressed and push the retaining member 71 until it stops against the lower end of the protrusion 62. The top end and the lower end of the protrusion 62 are fixed by being pressed against the retaining walls 311, 411 and the retaining member 71, respectively, so that the plural pairs of hairdressing scissors 2 can be hold in position firmly, providing a best stable positioning effect for enabling the hairstylist to hold the plural pairs of hairdressing scissors with one hand more easily and stably.

While we have shown and described various embodiments in accordance with the present invention, it should be clear to those skilled in the art that further embodiments may be made without departing from the scope of the present invention.

What is claimed is:

1. A pair of hairdressing scissors and a positioning device thereof comprising:

a first blade;

a second blade pivotally connected to the first blade;

at least a connecting structure arranged on at least one of the first and second blades, a front surface and a rear surface of the connecting structure being formed a recess and a protrusion, respectively, the connecting structure is defined a through hole and a stop portion formed at a front end of the through hole, the front end of the through hole connected to the recess, between the recess and the pair of hairdressing scissors is formed a retaining wall; and at least a positioning device disposed in the through hole and including a retaining member, an elastic member and a fixing member, the retaining member and the elastic member are sequentially placed in the through hole, and then the fixing member is inserted in the through hole, the elastic member is biased between the fixing member and the retaining member in such a manner that the retaining member partially protrudes out of the front end of the through hole and is pressed against the stop portion;

when coupling two pairs of hairdressing scissors together, the protrusion of a pair of hairdressing scissors is engaged in the recess of another pair of hairdressing scissors, the protrusion moves toward and member completely and a top end of the protrusion stops against the retaining wall, the retaining member will partially project out of the front end of the through hole and stop against a lower end of the protrusion, so that the plural pairs of hairdressing scissors are positioned firmly.

2. The pair of hairdressing scissors and a positioning device thereof as claimed in claim 1, wherein the fixing member and the through hole are connected by bell and spigot joint.

3. The pair of hairdressing scissors and a positioning device thereof as claimed in claim 1, wherein the elastic member is spring.

4. The pair of hairdressing scissors and a positioning device thereof as claimed in claim 1, wherein the retaining member is a ball.

5. The pair of hairdressing scissors and a positioning device thereof as claimed in claim 1, wherein said positioning device disposed in the through hole further comprising said retaining member with a supporting rod and a positioning piece.

6. The pair of hairdressing scissors and a positioning device thereof as claimed in claim 5, wherein the fixing member and the through hole are connected by bell and spigot joint.

7. The pair of hairdressing scissors and a positioning device thereof as claimed in claim 5, wherein the elastic member is spring.

8. The pair of hairdressing scissors and a positioning device thereof as claimed in claim 5, wherein the retaining member is a ball.

* * * * *